US010750834B2

(12) United States Patent
Wang

(10) Patent No.: US 10,750,834 B2
(45) Date of Patent: Aug. 25, 2020

(54) BAG PROVIDED WITH EXPANSION MEANS

(71) Applicant: Tsun Ho Wang, Seoul (KR)

(72) Inventor: Tsun Ho Wang, Seoul (KR)

( * ) Notice: Subject to any disclaimer, the term of this patent is extended or adjusted under 35 U.S.C. 154(b) by 0 days.

(21) Appl. No.: 16/310,053

(22) PCT Filed: Jun. 14, 2017

(86) PCT No.: PCT/KR2017/006179

§ 371 (c)(1),
(2) Date: Dec. 14, 2018

(87) PCT Pub. No.: WO2017/217755

PCT Pub. Date: Dec. 21, 2017

(65) Prior Publication Data

US 2019/0254397 A1 Aug. 22, 2019

(30) Foreign Application Priority Data

Jun. 14, 2016 (KR) ..... 10-2016-0073951

(51) Int. Cl.

| | |
|---|---|
| ***A45C 7/00*** | (2006.01) |
| ***B65D 33/06*** | (2006.01) |
| ***A45C 9/00*** | (2006.01) |
| ***B65D 81/05*** | (2006.01) |
| ***A47C 7/02*** | (2006.01) |
| ***B65D 33/10*** | (2006.01) |

(Continued)

(52) U.S. Cl.

CPC ..... *A45C 7/0081* (2013.01); *A45C 7/00* (2013.01); *A45C 7/0063* (2013.01); *A45C 9/00* (2013.01); *A47C 7/021* (2013.01); *B65D 31/12* (2013.01); *B65D 33/06* (2013.01); *B65D 33/105* (2013.01); *B65D 81/052* (2013.01); *B65D 81/36* (2013.01)

(58) Field of Classification Search

CPC ..... A45C 7/0081; A45C 7/0063; B65D 33/06
USPC ..... 383/3; 224/644
See application file for complete search history.

(56) References Cited

U.S. PATENT DOCUMENTS 3,679,108 A * 7/1972 Ingram ..... A45F 3/04 224/644
5,178,310 A * 1/1993 Sowerby ..... A45F 4/02 224/153

(Continued)

FOREIGN PATENT DOCUMENTS

CN 2480182 Y 3/2002
KR 20-2000-0005696 U 4/2000

(Continued)

OTHER PUBLICATIONS

International Search Report for PCT/KR2017/006179 dated Oct. 18, 2017 from Korean Intellectual Property Office.

(Continued)

*Primary Examiner* — Peter N Helvey
(74) *Attorney, Agent, or Firm* — Paratus Law Group, PLLC

(57) ABSTRACT

A bag provided with an expansion member, including: a bag body having a storage space formed therein; a cushion pocket forming a predetermined space inside the storage space of the bag body; and an expansion member which is accommodated in the cushion pocket, and of which the total volume is variable when air is injected or discharged through an injection portion.

9 Claims, 11 Drawing Sheets

(51) Int. Cl.
*B65D 81/36* (2006.01)
*B65D 30/22* (2006.01)

(56) References Cited

U.S. PATENT DOCUMENTS 5,349,706 A * 9/1994 Keer ..... A41D 13/0012 2/300
5,419,473 A * 5/1995 Lamar ..... A63B 55/00 224/632
5,547,461 A * 8/1996 Levis ..... A45F 3/04 128/876
5,639,004 A * 6/1997 Carlton ..... A45C 9/00 190/125
5,762,250 A * 6/1998 Carlton ..... A45C 9/00 108/43
5,957,356 A * 9/1999 Potempa ..... A45F 3/04 224/259
6,109,495 A * 8/2000 Hernandez ..... A45F 3/12 224/264
6,471,105 B1 * 10/2002 Ammerman ..... A45C 13/30 150/110
6,793,112 B2 * 9/2004 Ammerman ..... A45F 3/02 224/257
6,863,202 B2 * 3/2005 Ammerman ..... A45C 13/30 150/110
8,708,206 B2 * 4/2014 Onessimo ..... A45F 3/04 224/576
2002/0074374 A1 * 6/2002 Holbl ..... A45F 3/04 224/644
2002/0158097 A1 * 10/2002 Beale ..... A45F 3/04 224/644
2007/0215662 A1 * 9/2007 Zalinsky ..... A45F 3/12 224/644
2008/0296328 A1 12/2008 Wu
2010/0308095 A1 * 12/2010 Lam ..... A45F 3/04 224/644
2011/0120893 A1 * 5/2011 Rekuc ..... A45C 13/021 206/320
2012/0085804 A1 * 4/2012 Christy ..... A45C 13/02 224/644
2013/0075438 A1 * 3/2013 Christy ..... A45F 3/042 224/644

FOREIGN PATENT DOCUMENTS

KR 20-0326437 Y1 9/2003
KR 10-0748855 B1 8/2007
KR 20-2010-0001524 U 2/2010

OTHER PUBLICATIONS

Chinese Office Action for related CN Application No. 201780016234.7 dated Aug. 26, 2019 from Chinese Intellectual Property Office.

* cited by examiner

BAG PROVIDED WITH EXPANSION MEANS

CROSS REFERENCE TO PRIOR APPLICATIONS

This application is a National Stage Patent Application of PCT International Patent Application No. PCT/KR2017/006179 filed on Jun. 14, 2017 under 35 U.S.C. § 371, which claims priority to Korean Patent Application No. 10-2016-0073951 filed on Jun. 14, 2016, which are all hereby incorporated by reference in their entirety.

BACKGROUND

The present invention relates to a bag provided with an expansion means and, more particularly, to a bag provided with an air cushion whereby it is possible to use the bag as a cushion by using an expansion means expanding by air injection.

Generally, a bag is a portable auxiliary tool to carry books, items, or something, and a wide variety of bags such as backpacks or handbags are used. Recently, eco bags are widely used due to the increased interest in the environment. The eco bags refer to multi-purpose shopping bags that can be used as shopping bags and are made of fabric, in order to solve problems that arise from buying goods at stores and putting the goods in plastic bags, that is, a problem of plastic bag waste that does not decompose for a long time and a problem of waste of oil for manufacturing the plastic bags.

Such bags are used for storing and carrying items, but recently, bags with various functions are used. For example, a cushion is added into a bag for protecting the items storing inside the bag, or improving the fit of the bag. Such cushion may be used to for a purpose of improving seating feeling when a user sits down with the bag to use the bag as the cushion.

However, such cushion cannot be detachable, and even if detachable, it is inconvenient to carry the cushion because the cushion always has a predetermined volume larger than a preferred size. Further, the cushion is used to increase comfort of the bag or to increase the seating feeling thereof, but entire cushion protrudes to outside, which can damage esthetic feeling of the bag.

SUMMARY

Accordingly, the present invention has been made keeping in mind the above problems occurring in the prior art, and an object of the present invention is to provide a bag that can be used as a cushion when a user wants, by an expansion means of which a size is variable through air injection.

Another object of the present invention is to make it possible to easily inject air into or remove the air from the cushion.

In order to accomplish the above object, the present invention provides a bag provided with an expansion means, the bag including: a bag body having a storage space formed therein; a cushion pocket forming a predetermined space inside the storage space of the bag body; and an expansion means which is accommodated in the cushion pocket, and of which the total volume is variable when air is injected or discharged through an injection portion.

The cushion pocket is provided on an inner surface of the storage space of the bag body, and is opened in either direction so that the expansion means may be put in and taken out of the cushion pocket.

The expansion means may include an expansion body forming an air injection space into which air is injected, and the injection portion which is provided on the expansion body and allows the air injection space to selectively communicate with outside.

The cushion pocket may be formed by an inner attachment portion of a fabric material that is attached to the inner surface of the storage space, and at least two inner attachment portions may be provided at different positions inside the storage space.

On an outer surface of the bag body, a protrusion corresponding to a shape of the expansion means may be formed, and the protrusion may be made of a shape-variable material, so when air is injected into the air injection space of the expansion means and the expansion means expands, the protrusion may be pushed by the expanded expansion means and protrude to the outside of the bag body.

The protrusion may be configured as characters, logos, letters, numbers, or a combination thereof.

On the storage space of the bag body, a shielding means at least partially attached to an inner surface of the storage space may be provided, and the shielding means may allow the injection portion of the expansion means to be selectively shielded.

The injection portion may include an injection frame coupled to the expansion body of the expansion means and having an air hole through which air passes to the air injection space, and a valve plate mounted in close contact with an edge of the air hole, of which a first end is fixed to the injection frame and a second end is provided to be spaced apart from the injection frame, thereby allowing the air hole to be selectively shielded.

When air is injected toward the air hole, the valve plate may be elastically deformed by the air and at least a part of the valve plate may be separated from the edge of the air hole to open the air hole, and when air injection is stopped, the valve plate may be restored to an original shape thereof and come into close contact with the edge of the air hole to shield the air hole.

As described above, the bag provided with the expansion means according to the present invention has the following effects.

The bag of the present invention can be used as a cushion using the expansion means, since the expansion means can expand and contract, the bag is selectively used as the cushion when a user wants. Thus, the expansion means contracts to reduce volume of the bag in normal, thereby improving portability of the bag, and when the user wants to use the bag as the cushion, the expansion means expands to be used as the cushion, thereby improving usability of the bag.

In addition, since the expansion means of the present invention is formed into a three-dimensional shape of a specific shape, the expansion means may be used as a logo or a character for marketing, and may be used to protect items storing in a storage space of the bag by using a buffer function of the expansion means.

Further, the expansion means of the present invention can be used in a bag that is difficult to maintain a specific shape as a fabric bag and can have a function of maintaining the shape of the bag, and the expansion means can be used for marine rescue in an emergency.

In addition, the injection portion of the expansion means can be opened only in an air injection direction, and when air injection is stopped, the injection portion is restored to original state thereof and shields the air hole, thus the user can easily inject air into the expansion means, thereby improving the usability.

Further, when the injection portion for injecting air into the expansion means is exposed to the outside of the bag, the user can easily use by expanding the expansion means, thereby improving the usability.

DETAILED DESCRIPTION

Figure 1:
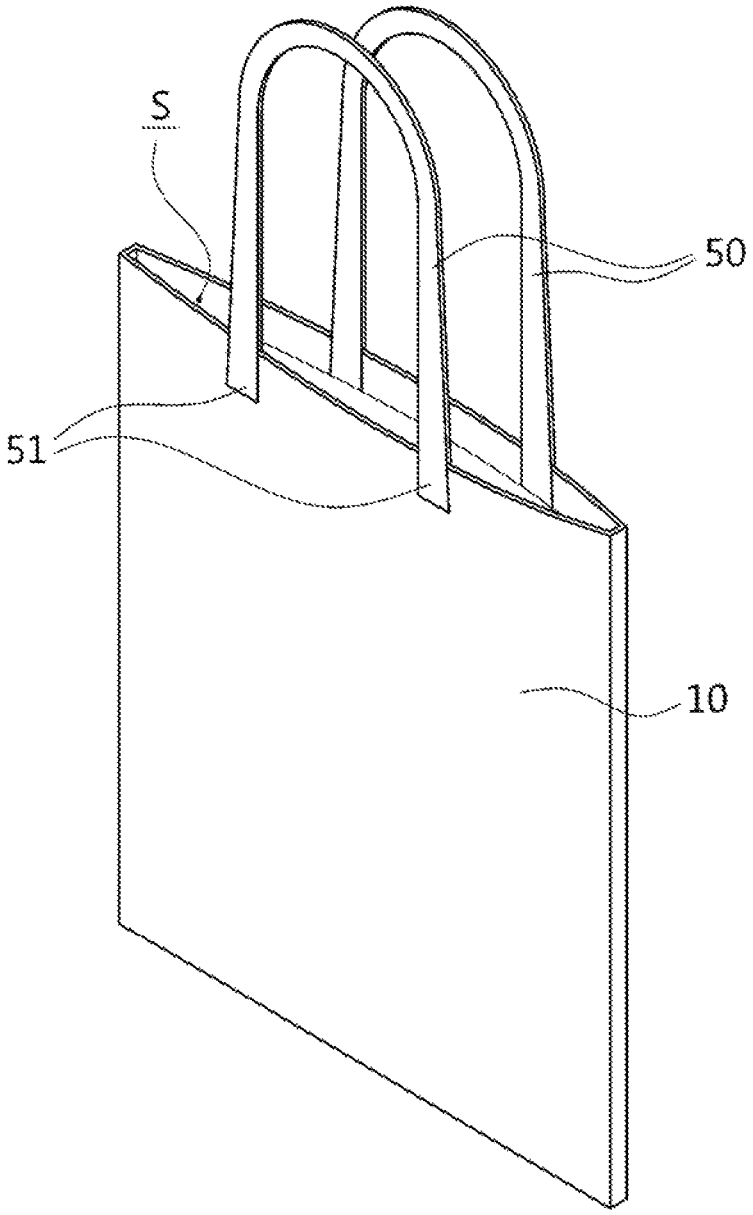
FIG. 1 is a perspective view showing a state, in which an expansion means configuring an embodiment of a bag provided with the expansion means according to the present invention contracts.

Hereinbelow, some embodiments of the present invention will be described in detail with reference to the accompanying drawings. The same reference numerals throughout the drawings denote elements having the same or similar function. In addition, in the following description of the embodiments of the present invention, detailed descriptions of known functions and components incorporated herein will be omitted when it may make the subject matter of the present invention unclear.

Further, when describing the components of the present invention, terms such as first, second, A, B, (a) or (b) may be used. Since these terms are provided merely for the purpose of distinguishing the components from each other, they do not limit the nature, sequence or order of the components. It will be understood that when an element is referred to as being "coupled", "combined", or "connected" to another element, it can be directly coupled, combined, or connected to the other element or intervening elements may be present therebetween.

The present invention relates to a bag provided with an expansion means, which can add various functions such as cushioning, protecting stored items, or decorating and advertising functions to the bag using an expansion means 60. The expansion means 60 is detachably provided inside a bag body 10. Hereinafter, each configuration of the bag will be described in detail.

As shown in FIG. 1, the bag body 10 constitutes most of an appearance of the bag, and has a storage space S formed therein for storing and carrying various belongings. The bag body 10 is not limited to a rectangular shape as shown in FIG. 1, and may have various shapes including a circular shape and a polygonal shape. In the embodiment, the bag body 10 is made of a fabric material, but the bag body 10 may be made of various materials that can change a shape thereof, such as leather.

Figure 2:
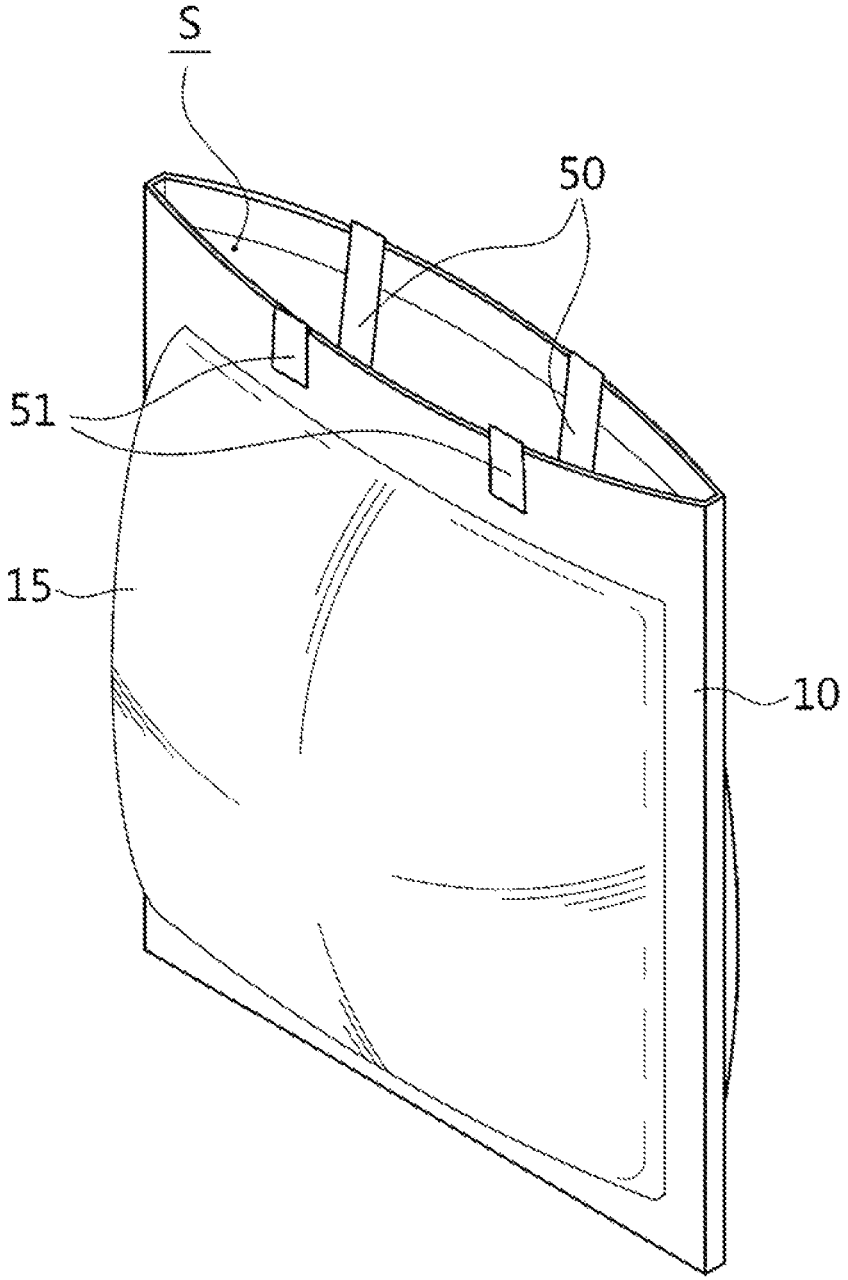
FIG. 2 is a perspective view showing a state, in which the expansion means configuring the embodiment of the bag provided with the expansion means according to the present invention expands.

FIG. 2 shows a state in which a part of the bag body 10 protrudes by expansion of the expansion means 60 that will be described below. A protruding portion of the bag body 10 may be a part of the bag body 10 being pushed by the expansion means 60 and protruding forward naturally, or a protrusion 15 provided separately on the bag body 10 protruding forward. Since the bag body 10 is made of a shape-transformable material such as fabric or leather, when the expansion means 60 inside the bog body expands, the bag body 10 may naturally become a protruding shape.

The protrusion 15 is not shown in accompanying drawings, but is provided on the bag body 10, and has a structure that is possible to protrude from the bag body 10. For example, the protrusion 15 may usually stay in a somewhat loose shape, but be a structure of tightening by being pushed by the expansion means 60. In this case, the bag body 10 may have a fixed shape rather than a variable shape, and only the protrusion 15 may be the variable shape.

Figure 9:
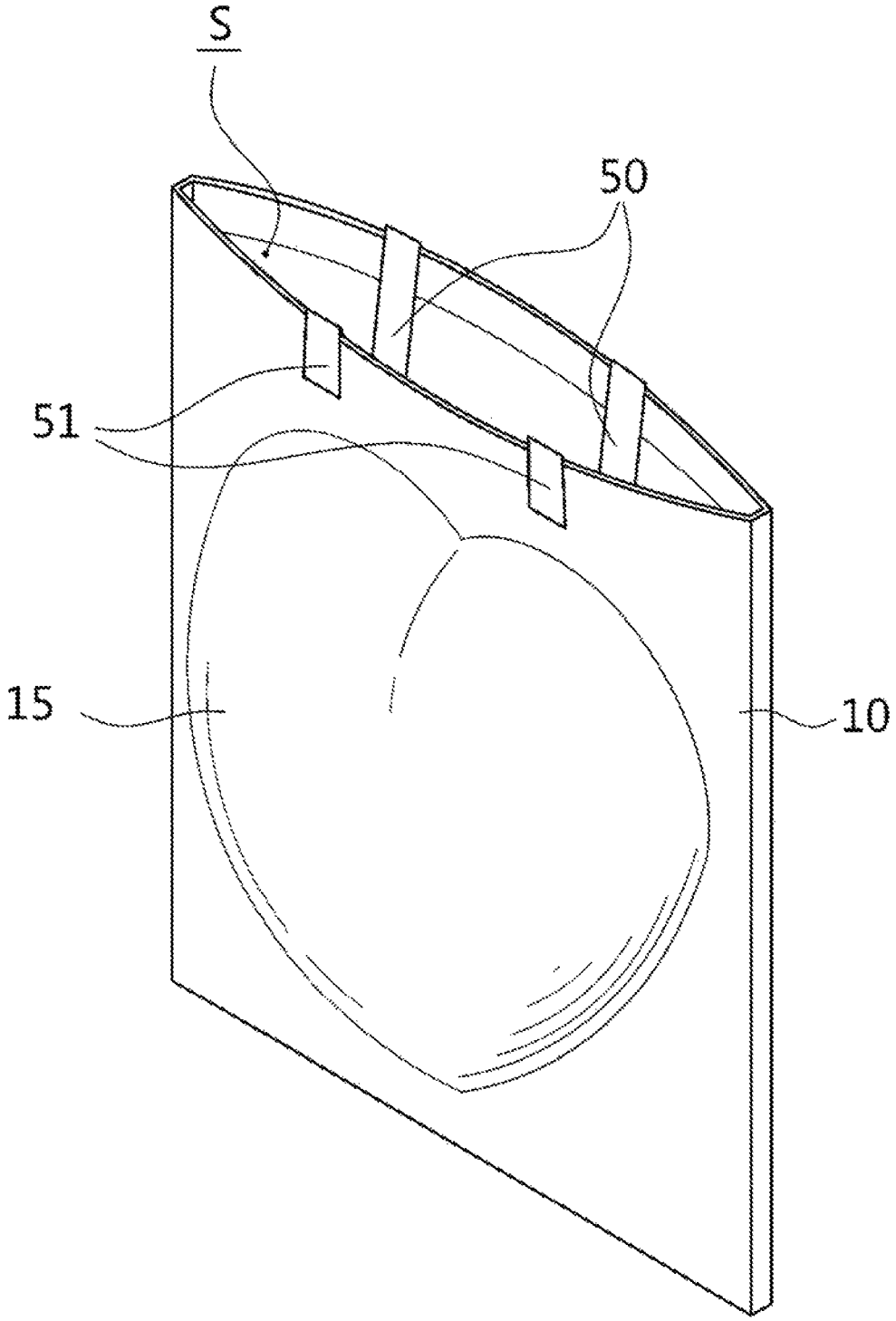
FIG. 9 is a perspective view showing a bag to which a second embodiment of the expansion means configuring the embodiment of the present invention is applied.

For example, when the bag body 10 is made of thick material, a shape of the bag body does not vary. However, since the protrusion 15 made of a fabric material is attached to the center of the bag body 10, the expansion means can push the protrusion 15 to be protruded. Referring to FIG. 9, an example of the bag providing the protrusion 15 having a heart shape is shown in the drawing. The protrusion 15 may be configured as characters, logos, letters, numbers, or a combination thereof. Here, the characters may be design characters of characterizing people or animals, the logos may be symbols of representing companies or organizations. Using this protrusion described above, when the expansion means 60 expands, this protrusion 15 protrudes thereby increasing an esthetic feeling of the bag or being used for marketing.

Figure 3:
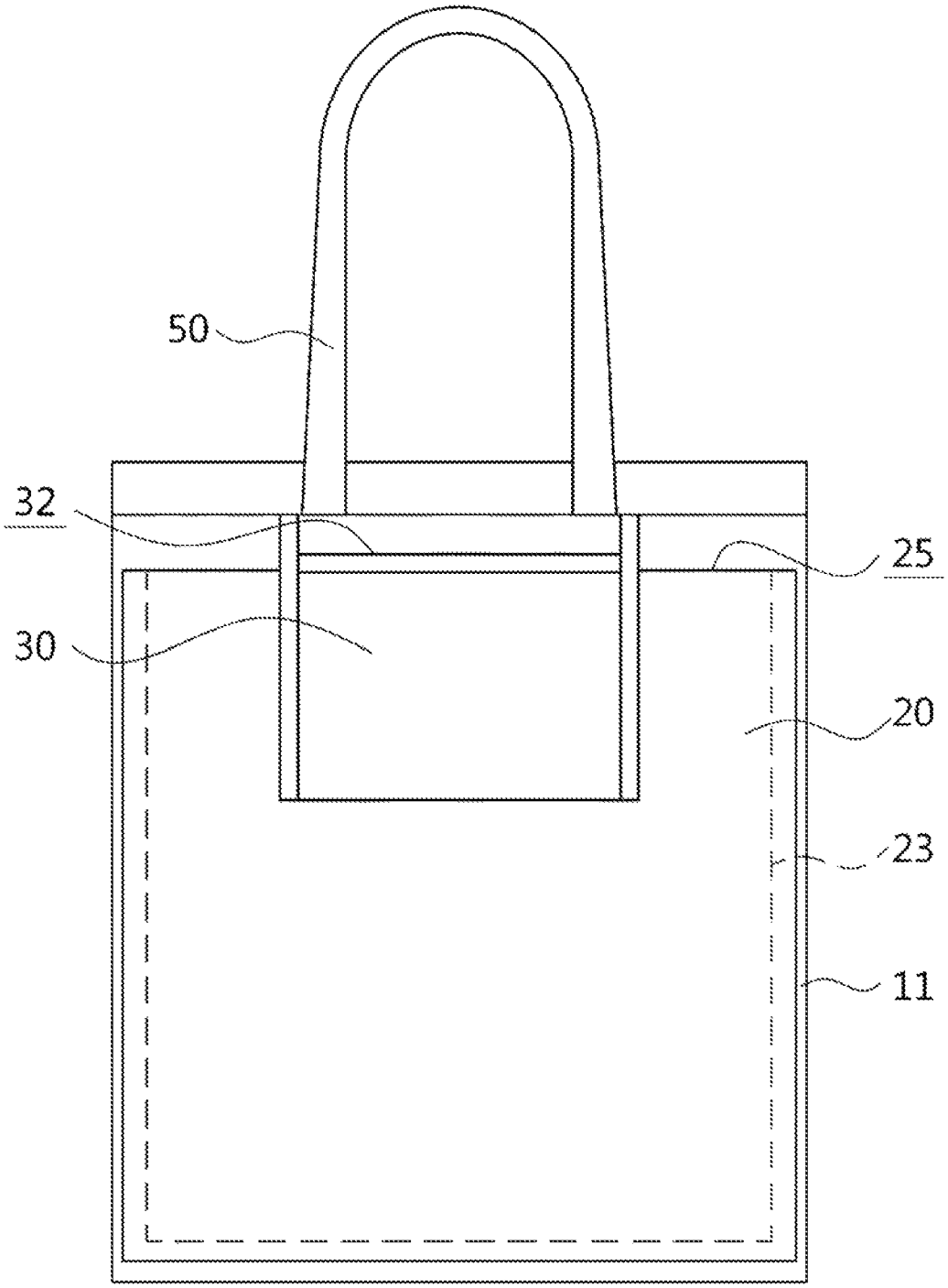
FIG. 3 is a front view showing an inner structure of a bag body configuring the embodiment of the present invention by turning the bag body inside out.
Figure 4:
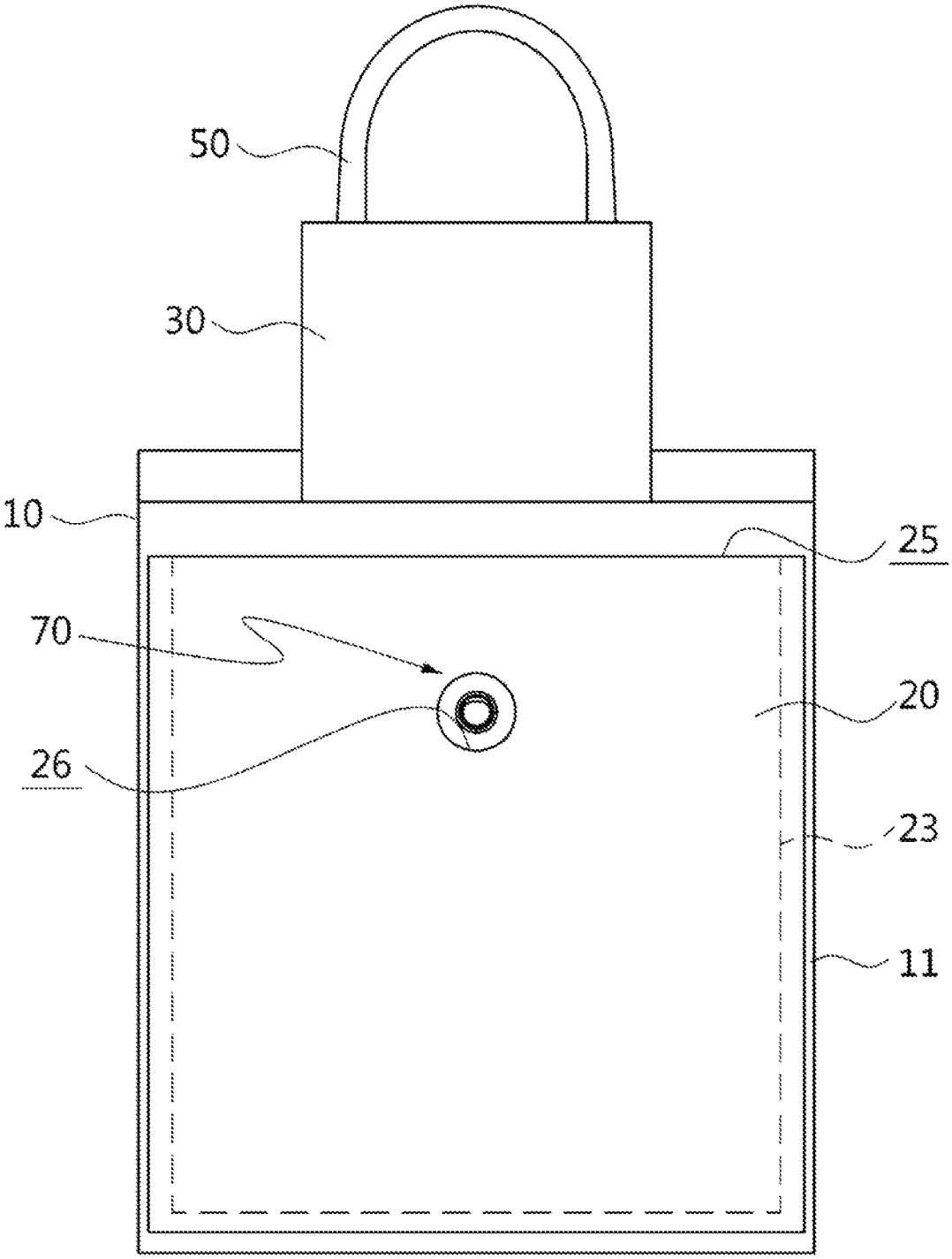
FIG. 4 is a front view showing a state, in which a shielding means is lifted up to expose an injection portion of the expansion means configuring the embodiment of the present invention, at FIG. 3.

An inner structure of the bag body 10 is shown in FIG. 3. FIGS. 3 and 4 show bags in a state of turning inside out so that an inner surface configuring the storage space S of the bag is exposed to outside. As shown in the drawings, a cushion pocket 20 is provided on the inner surface 11 of the bag body. The cushion pocket 20 is a space for storing the expansion means 60, the cushion pocket 20 forms a predetermined space, more accurately, forms a cushion space 25.

In the embodiment of the present invention, the cushion pocket 20 is configured such that a fabric material such as thin cloth is attached to the inner surface of the bag body 10. The cushion pocket 20 is configured as an inner attachment portion of the fabric material, and forms a shape in which remaining parts of the cushion pocket except for an opening are sewn to the inner surface 11 of the bag body 10. Reference numeral 23 indicates a seam line of the inner attachment portion. Of course, the inner attachment portion configuring the cushion pocket 20 may be attached to the inner surface 11 of the bag body 10 in various ways, such as a zipper, button, or Velcro.

As another example of the cushion pocket 20, the cushion pocket 20 may be configured to be detachable shape from the storage space S of the bag body 10. That is, the cushion pocket 20 may have a form of a sub-bag independent from the bag body 10, and may be selectively attached to the storage space S of the bag body 10.

Otherwise, the cushion pocket 20 may be integrally formed with the bag body 10. For example, the cushion pocket 20 may be a part of the storage space S, not a separate compartment space. The cushion pocket 20 may be formed within layers of the bag body 10 formed of two layers of fabric, vinyl, synthetic resin, or metal.

A plurality of such cushion pocket 20 may be provided on the inner surface of the storage space S. That is, since at least two inner attachment portions configuring the cushion pocket 20 are provided at different positions inside the storage space S, a plurality of the cushion pockets 20 may be provided, and separate expansion means 60 may be stored in each cushion pocket 20.

As shown in FIG. 4, the cushion pocket 20 has a through hole 26. The through hole 26 is formed through a part of the cushion pocket 20, and the through hole 26 has an injection portion 70 of the expansion means 60 that will be described below. More precisely, when the expansion means 60 is inserted in the cushion space 25, since the injection portion 70 of the expansion means 60 is exposed to outside through the through hole 26, a user can inject air into the expansion means 60 through the injection portion 70.

Figure 10:
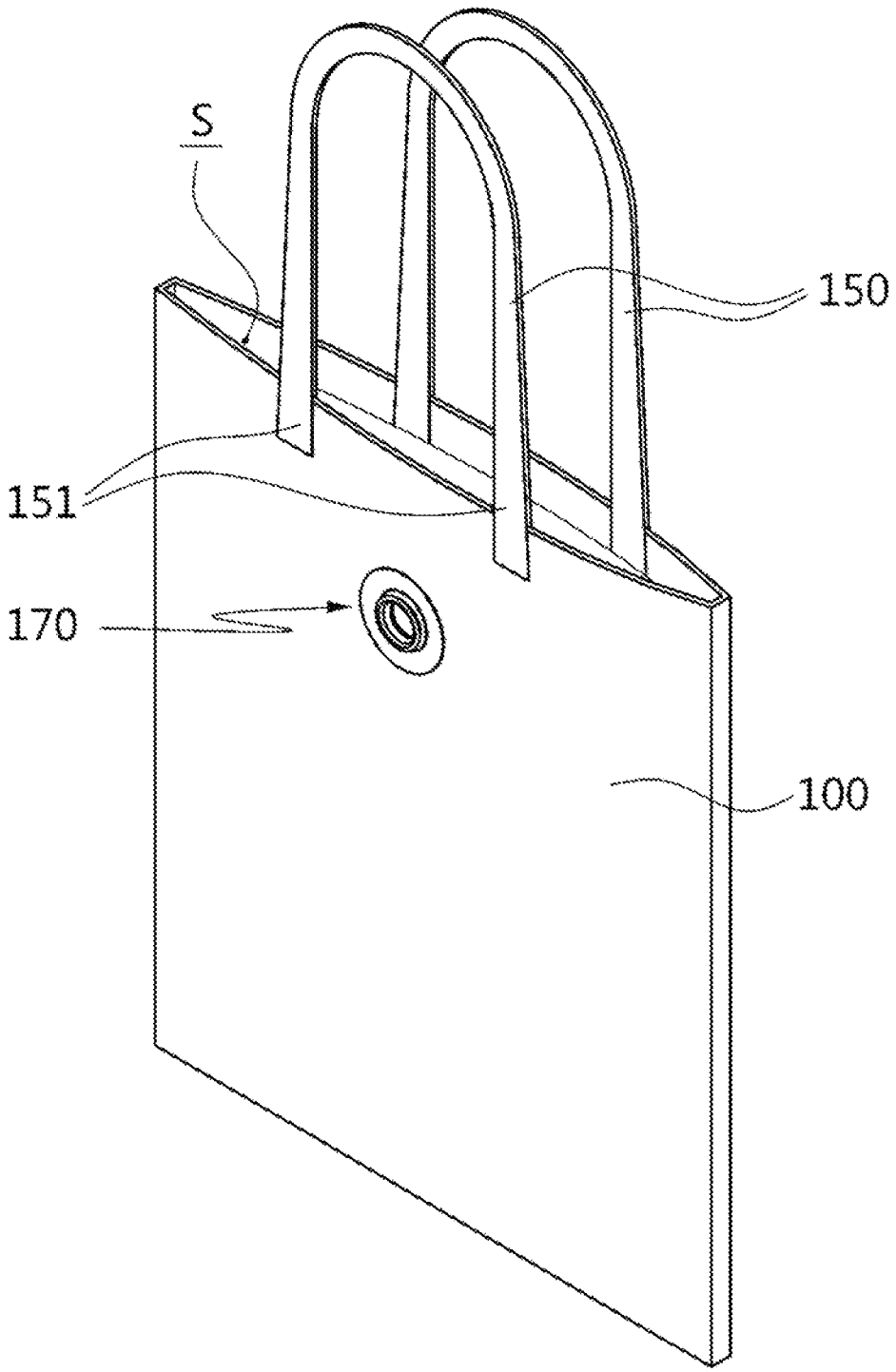
FIG. 10 is a perspective view showing a state, in which an expansion means configuring another embodiment of the bag provided with the expansion means according to the present invention contracts.

The through hole 26 may not necessarily be exposed inward the storage space S. Alternately, the through hole 26 may be opened in at least one of an inward direction of the storage space S and an outward direction of the bag body 10. For reference, FIG. 10 shows an embodiment in which the injection portion 70 of the expansion means 60 protrudes outwardly.

The storage space S is provided with a shielding means 30 at least partly attached to the inner surface of the storage space S. The shielding means 30 is for selectively shielding the injection portion 70 of the expansion means 60. FIG. 3 shows a state in which the shielding means 30 hangs down and the injection portion 70 is shielded, and FIG. 4 shows a state in which the shielding means 30 is lifted up and an injection portion 70 is exposed.

The shielding means 30 is only partially fixed to the inner surface of the storage space S, and a remaining portion can rotate around the fixed portion as a shaft. In an embodiment, the shielding means 30 is made of the fabric material. The shielding means 30 can prevent the injection portion 70 from being opened by external force by selectively shielding the injection portion 70. As shown in FIG. 3, the shielding means 30 may have a sub-storage space 32 having an opening formed at an upper portion of the shielding means 30. In this way, the shielding means 30 can function not only to shield the injection portion 70, but also to form another sub-space in the storage space S.

A handle 50 is provided on the bag body 10. The handle 50 allows the user to easily grip the bag, and has a fixed end 51 partially attached to the bag body 10. Since a portion of the handle 50 except the fixed end 51 may be moved independently, when the bag is used as a cushion as shown in FIG. 2, the portion of the handle 50 may be folded into the storage space S of the bag body 10.

The expansion means 60 is provided in the cushion space 25. The expansion means 60 is stored in the cushion pocket 20, and total volume of which is variable when the air is injected into or discharged from the expansion means 60 through the injection portion 70. The expansion means 60 expands by the air injection so that the bag body 10 can function as a kind of cushion. In addition, the expansion means 60 is stored in the cushion space 25 in a separable state.

Figure 5A:
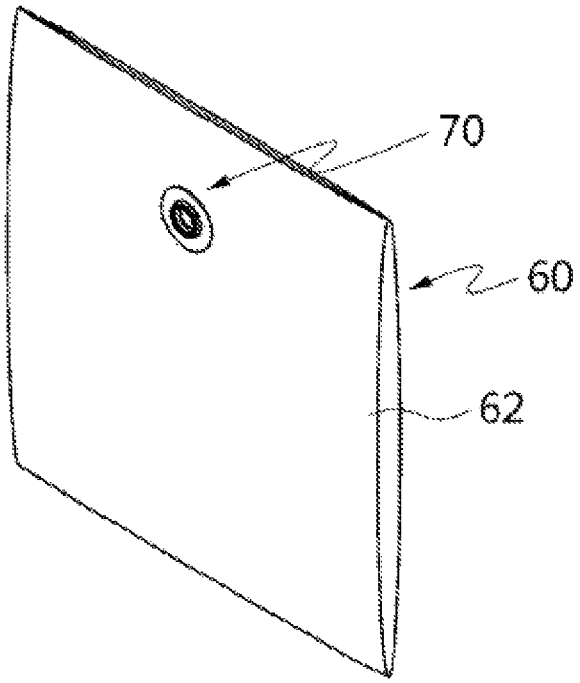
FIGS. 5A and 5B are perspective views showing contraction and expansion states of a first embodiment of the expansion means configuring the embodiment of the present invention, respectively.
Figure 5B:
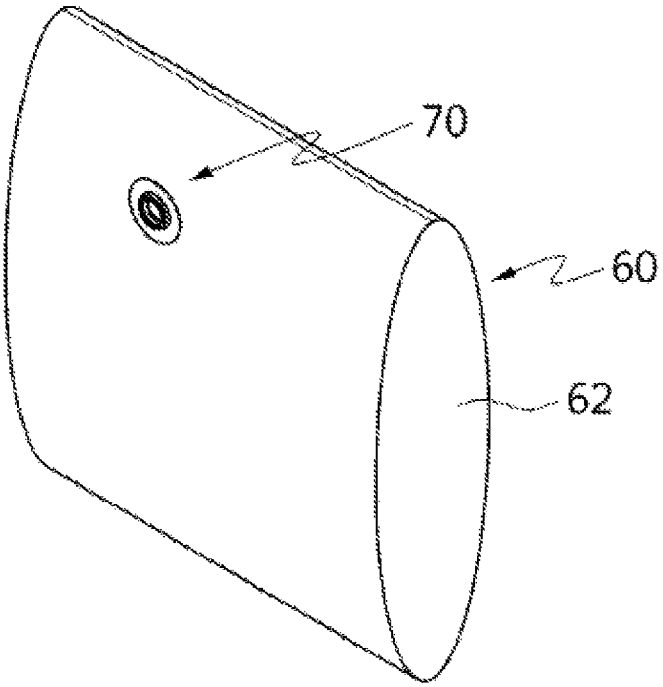
Figure 6:
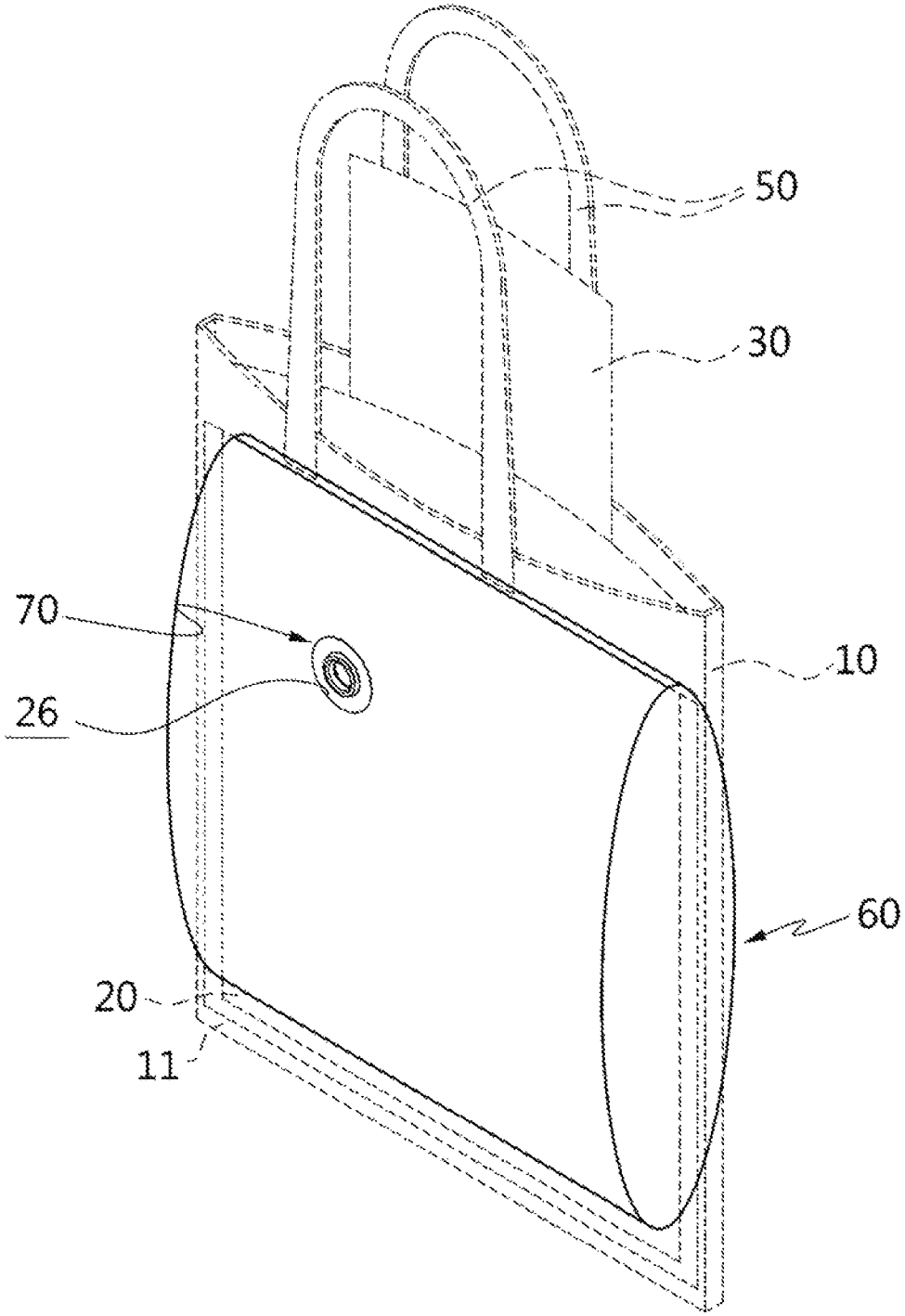
FIG. 6 is a schematic view showing an inner configuration of the bag body in a state in which the expansion means configuring the bag provided with the expansion means of the present invention expands.

The expansion means 60 may be made of various materials, but it is made of synthetic resin in the embodiment. As shown in FIG. 5, the expansion means 60 has, as a structure, an expansion body 62 forming an air injection space into which air is injected. The expansion means 60 may have various shapes, but FIG. 4 shows a side surface of the expansion means having a kind of oval shape, and a front surface thereof having a square shape to correspond to a shape of the bag. Of course, a shape of the expansion body 62 may be variously modified. For example, since the expansion body 62 has a ring shape with one side separated from another side, the expansion means 60 can be detached from the bag body 10 and used as a neck pillow. Alternately, the expansion body 62 may have an elongated structure extending in one direction.

In the embodiment described above, the expansion means 60 has an air tube form into which air is injected, but an object having a temperature control function such as a hot pack or an ice pack can be accommodated and used in the cushion space 25 together with the expansion means 60 of the air tube form.

Figure 7:
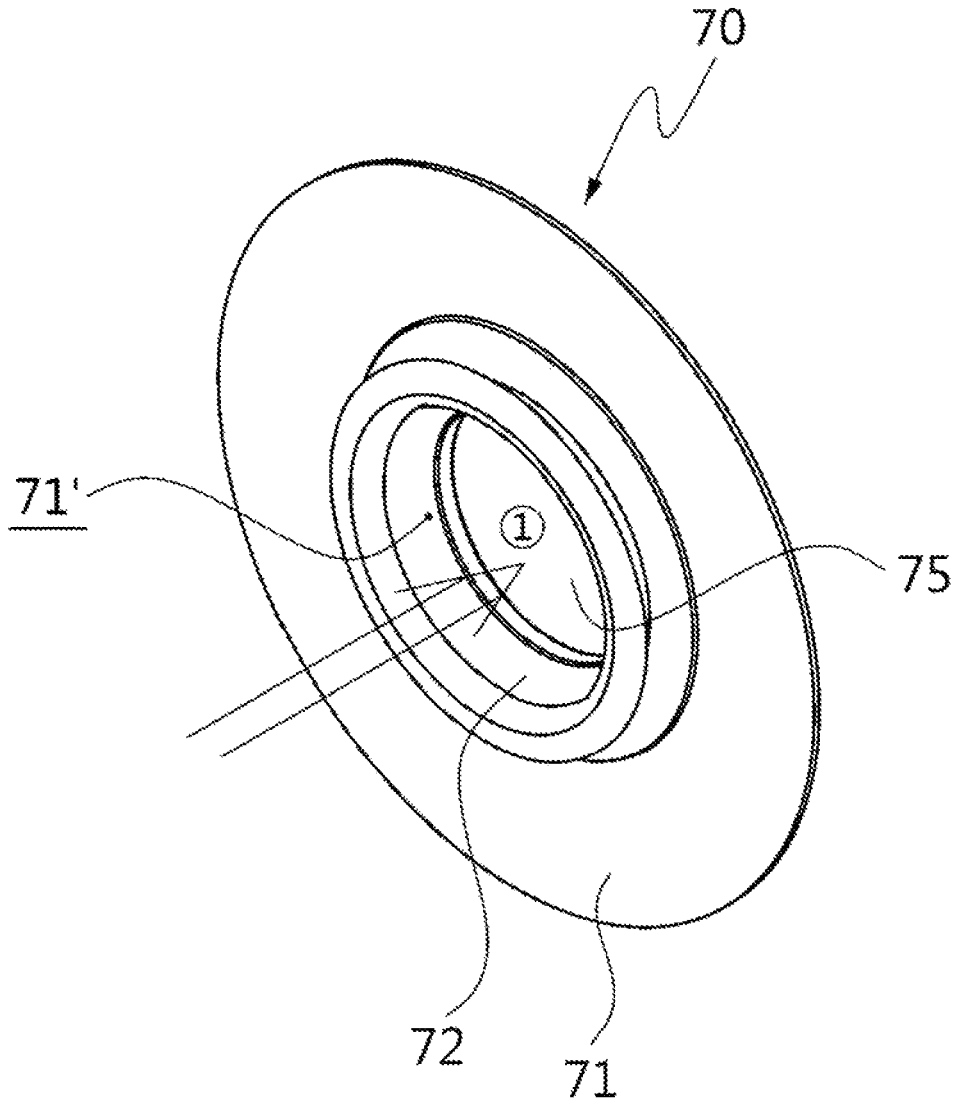
FIG. 7 is a perspective view showing an embodiment of the injection portion of the expansion means configuring the embodiment of the present invention.

The injection portion 70 is provided on one side of the expansion body 62. The injection portion 70 is provided on the expansion body 62 to allow air to be injected into or discharged from the air injection space. The exact shape of the injection portion 70 is shown in FIG. 7, as shown in the drawing, the injection portion 70 has, as a structure, an injection frame 71 coupled to the expansion body 62 of the expansion means 60 and having an air hole 71' through which air passes to the air injection space. The injection frame 71 is approximately a circular frame, and a protruding ring portion 72 is provided at the center of the injection frame 71. The protruding ring portion 72 protrudes from the injection frame 71 to facilitate the air injection.

The air hole 71' formed at the center of the protruding ring portion 72 is an air passage and is selectively opened by a valve plate 75. The valve plate 75 is mounted in close contact with an edge of the air hole 71', of which a first end is fixed to the injection frame 71 and a second end is provided to be possible of spacing apart from the injection frame 71. Accordingly, the valve plate 75 selectively shields the air hole 71' to control air injection and discharge processes.

Figure 8A:
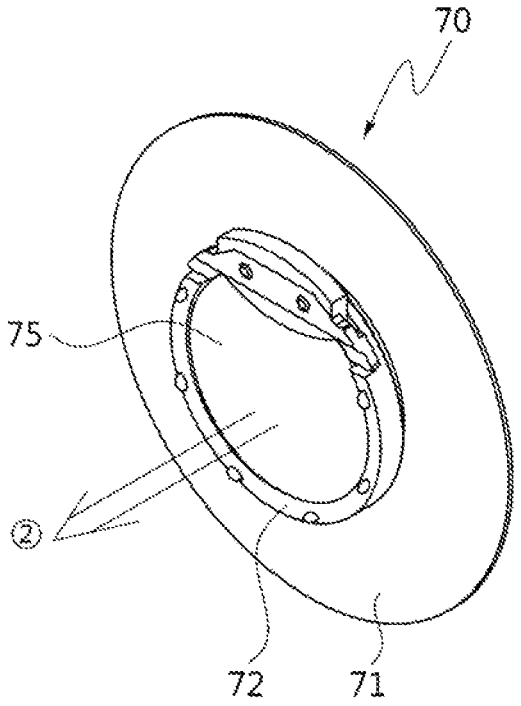
FIGS. 8A and 8B are perspective views showing open and closed states of a valve plate of the injection portion of the expansion means configuring the embodiment of the present invention, respectively.
Figure 8B:
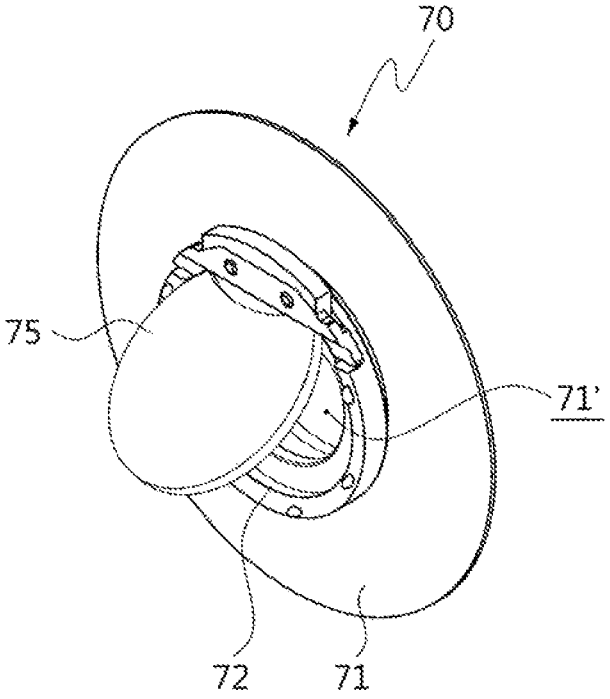

More precisely, when air is injected toward the air hole 71' and the valve plate 75 is elastically deformed by the air, at least a part of the valve plate 75 is separated from the edge of the air hole 71' to open the air hole 71' (referring to FIG. 8B), and when the air injection is stopped, the valve plate 75 is restored to an original shape thereof and comes into close contact with the edge of the air hole 71' to shield the air hole 71' (referring to FIG. 8A). Accordingly, without the user having to open and close the valve plate 75, the valve plate 75 is opened when air is injected toward the valve plate 75, and the valve plate 75 is closed when the air injection is stopped. In the embodiment, the injection portion 70 is a structure in which the user can blow air from the user's mouth.

Contrary, when the user presses the valve plate 75, the valve plate 75 is elastically deformed and opened, and inside air can be discharged to the outside. In the embodiment, the valve plate 75 is made of the synthetic resin or rubber of flexible material that is capable of being elastically deformed. However, the valve plate 75 is not necessary to be limited to an elastically deformable structure, and may be made of a material of high hardness. In addition, an end of valve plate 75 may be provided at the injection frame 71 to be rotatable through a hinge structure.

Of course, the injection portion 70 is not necessary to be limited to the structure described above. The injection portion 70 may be provided as a simply open hole and a cap shielding the open hole, or be variable in various ways.

Figure 11:
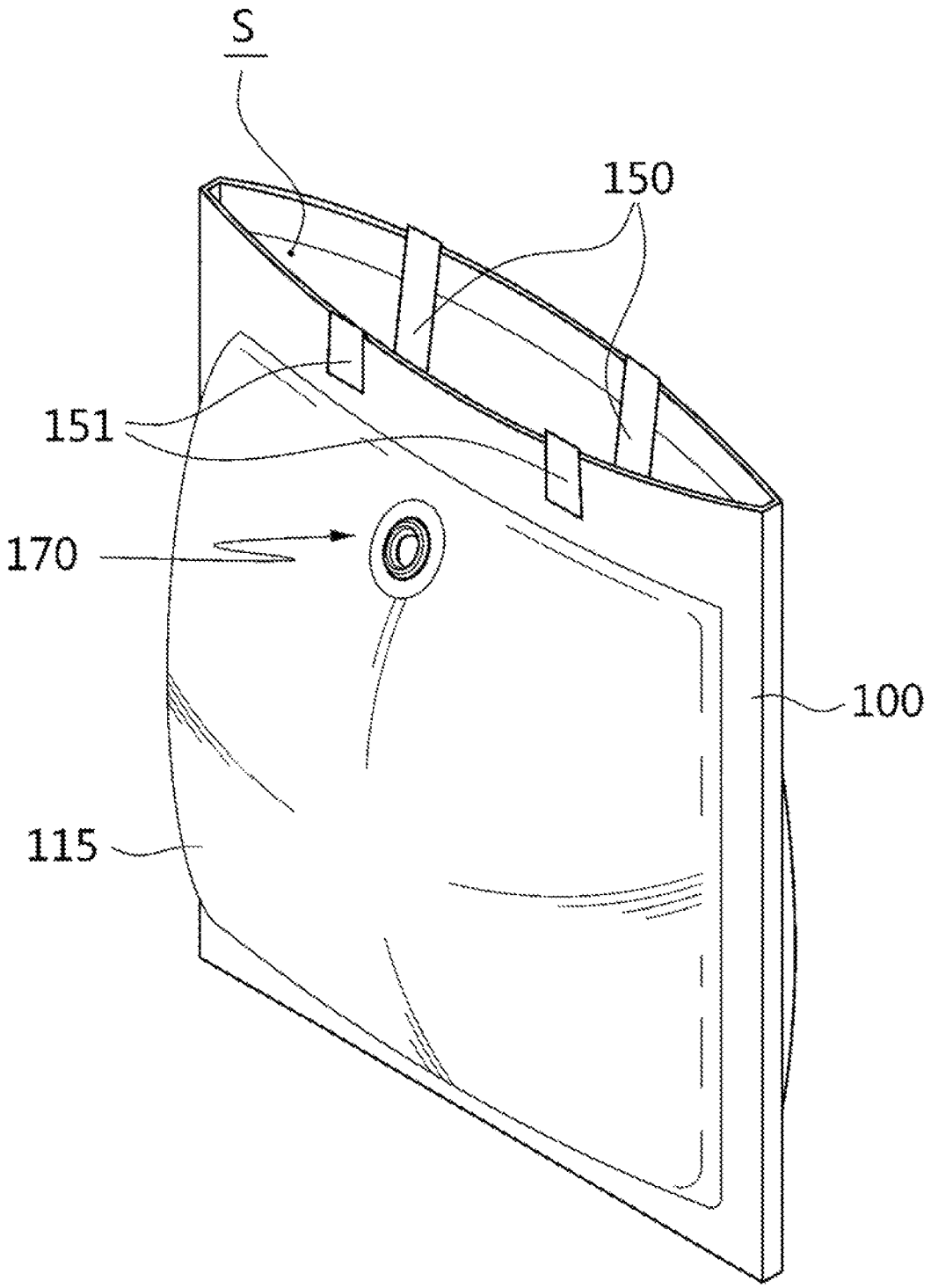
FIG. 11 is a perspective view showing a state, in which the expansion means configuring the other embodiment of the bag provided with the expansion means according to the present invention expands.

FIG. 10 shows another embodiment of the present invention. As shown in this drawing, the injection portion 70 may be provided on an outer surface of the bag body 10 to be exposed. The injection portion is connected to the cushion pocket (not shown in FIG. 10) and the expansion means and has a same function allowing air to be injected into or discharged from the expansion means as the previous embodiment, but the injection portion is exposed to the outside, not the inside of the storage space S of the bag body 10. Thus, the user can directly inject air through the injection portion 70 exposed to the outside without opening the inside of the bag. FIG. 11 shows a state in which air is injected into the expansion means using the other embodiment of FIG. 10.

Hereinafter, a process of using the bag provided with the expansion means according to the present invention will be described.

The user can normally use the bag in a state in which the expansion means 60 contracts. When the injection portion 70 of the expansion means 60 is opened to discharge inside air, the expansion means 60 contracts, thus the bag body 10 is also reduced in volume. This is shown in FIG. 1.

When the user tries to protect items stored in the storage space S or tries to protrude the protrusion 15 of the bag using expansion means 60 to improve esthetic feeling of the bag, the user can normally use the bag with expansion means 60 expanding (referring to FIG. 9). Alternately, the user can use the bag with a logo of the protrusion 15 protruding as part of promotion or marketing for a company.

When the user tries to use the bag as the cushion, air should be injected into the expansion means 60. To do this, the user first has to open the opening of the storage space S, and then lift up the shielding means 30 shielding the injection portion 70 to expose the injection portion 70. When the injection portion 70 is exposed, the user can inject air into the injection portion 70 by blowing the air from the user's mouth. Here, since the valve plate 75 of the injection portion 70 is elastically deformed by the air injected toward the air hole 71', when the user blows the air toward the air hole 71', at least a part of the valve plate 75 is separated apart from the edge of the air hole 71' and the air hole 71' is opened, thus the air is injected into the expansion means 60.

When the expansion means 60 expands by the air injected, the expansion means 60 pushes the bag body 10 outward to have the protruding shape. When the protrusion 15 is separately provided on the bag body 10, the expansion means 60 allows the protrusion to protrude outward. Thus, when the expansion means 60 expands, the expansion means 60 has an air cushion function, the user can use the bag as a kind of cushion. For example, the bag may be used for supporting a part of the body such as the cushion or a lumbar support. Also, the expansion means 60 may protect the items inside the storage space S, or may maintain a three-dimensional shape of the bag body 10.

Meanwhile, when the user releases the air cushion function of the bag, the expansion means 60 should contract. When the user pushes the valve plate 75 provided on the injection portion 70 of the expansion means 60 inward by using a user's finger, the valve plate 75 is deformed thereby opening the air hole 71', and the air inside the expansion means 60 is discharged to the outside. In addition, in the process, the expansion means 60 contracts and the volume of the bag decreases together.

Thus, in the present invention, since expansion and contraction of the expansion means 60 is possible, the bag can be selectively used as the cushion when the user wants. Therefore, as the expansion means 60 normally contracts thereby reducing the volume of the bag, portability of the bag can be improved, and when the bag is used as the cushion, the user can expand the expansion means 60 and use the bag as a cushion.

The user can separate the expansion means 60 from the cushion pocket 20, and replace the expansion means 60 or use the expansion means 60 as a separate product, when the user wants. Since the expansion means 60 can be easily separated from and inserted into the cushion pocket 20, the above process can be conveniently operated.

Hereinabove, the present invention is not necessarily limited to the embodiments as described above in which all components configuring the embodiments according to the present invention are described as being integrally combined or operated. That is, within the scope of the present invention, at least one of the all components may be selectively combined and operated. In addition, unless the context clearly indicates otherwise, since the terms "comprise", "include", "have", etc. when used in this specification, is meant that the component is inherent in the present invention, and it will be further understood that the terms specify the presence of stated features, integers, steps, operations, elements, and/or components, but do not preclude the presence or addition of one or more other features, integers, steps, operations, elements, components, and/or groups thereof. Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Although a preferred embodiment of the present invention has been described for illustrative purposes, those skilled in the art will appreciate that various modifications, additions and substitutions are possible, without departing from the scope and spirit of the invention as disclosed in the accompanying claims. Therefore, the embodiments disclosed in the present invention is intended to describe the technical spirit, not to limit, and the scope of the technical spirit of the present invention is not limited to the embodiments. The patent right of the present invention should be defined by the accompanying claims described below, and it should be understood that all technical spirit within the scope of the same are included in the scope of the present invention.

The invention claimed is:

1. A bag provided with an expansion means, the bag comprising:

a bag body having a storage space formed therein;

a cushion pocket forming a predetermined space inside the storage space of the bag body and having an opening spatially connecting the predetermined space of the cushion pocket with the storage space of the bag body; and an expansion means which is accommodated in the cushion pocket, and of which the total volume is variable when air is injected or discharged through an injection portion, the expansion means including an expansion body forming an air injection space into which the air is injected, and the injection portion provided on the expansion body and allowing the air injection space to selectively communicate with an outside, wherein the injection portion comprises:

an injection frame coupled to the expansion body of the expansion means and having an air hole through which the air passes to the air injection space, and a valve plate being in a flat plate shape, mounted in close contact with an edge of the air hole, and having a first end fixed to the injection frame and a movable second end opposite to the first end and positioned being in close contact with an edge of the air hole, and wherein the valve plate is configured to be elastically deformed by injected air when the air is injected toward the air hole such that the movable second end of the valve plate is separated from the injection frame by the injected air and opens the air hole, and the valve plate is configured to be restored to an original shape thereof when air injection is stopped such that the movable second end comes into close contact with the edge of the air hole and shields the air hole.

2. The bag provided with the expansion means of claim 1, wherein the cushion pocket is provided on an inner surface of the storage space of the bag body, and the opening is formed in either direction so that the expansion means is put in and taken out of the cushion pocket.

3. The bag provided with the expansion means of claim 1, wherein the cushion pocket is formed by an inner attachment portion of a fabric material that is attached to the inner surface of the storage space, and at least two inner attachment portions are provided at different positions inside the storage space.

4. The bag provided with the expansion means of claim 1, wherein, on an outer surface of the bag body, a protrusion corresponding to a shape of the expansion means is formed, and the protrusion is made of a shape-variable material, so when air is injected into the air injection space of the expansion means and the expansion means expands, the protrusion is pushed by the expanded expansion means and protrudes toward the outside of the bag body.

5. The bag provided with the expansion means of claim 4, wherein the protrusion is configured to form characters, logos, letters, numbers, or a combination thereof.

6. The bag provided with the expansion means of claim 1, wherein, on the storage space of the bag body, a shielding means at least partially attached to an inner surface of the storage space is provided, and the shielding means allows the injection portion of the expansion means to be selectively shielded.

7. The bag provided with the expansion means of claim 1, wherein the injection portion is provided on an outer surface of the bag body and is exposed to the outside, and the injection portion is connected to the cushion pocket so that air is injected into or discharged from the cushion pocket.

8. The bag provided with the expansion means of claim 1, wherein the cushion pocket has a through hole in which the injection portion of the expansion means is positioned, and the through hole is opened in at least one of an inward direction of the storage space of the bag body and an outward direction of the bag body.

9. The bag provided with the expansion means of claim 1, wherein the cushion pocket is formed integrally with the bag body.

* * * * *